US005088886A

United States Patent [19]

Hopkins

[11] Patent Number: 5,088,886

[45] Date of Patent: Feb. 18, 1992

[54] INLET AIR FLOW CONDITIONING FOR CENTRIFUGAL FANS

[75] Inventor: Lawrence D. Hopkins, Happy Valley, Oreg.

[73] Assignee: Sinko Kogyo Co., Ltd., Japan

[21] Appl. No.: 574,202

[22] Filed: Aug. 28, 1990

[51] Int. Cl.[5] ..... F01D 25/00

[52] U.S. Cl. ..... 415/119; 415/206

[58] Field of Search ..... 415/182.1, 183, 184, 415/151, 208.1, 914, 121.2, 224, 212.1, 203, 206, 208.1, 121.2, 119; 220/657, 642; 416/247 R, 247 A

[56] References Cited

U.S. PATENT DOCUMENTS

| | | | |
|---|---|---|---|
| 1,211,439 | 1/1917 | Hall | 220/642 |
| 2,112,608 | 3/1938 | Schmidt | 415/119 |
| 2,801,044 | 9/1952 | Bowie | 415/147 |
| 3,096,080 | 7/1963 | Willems | 415/119 |
| 3,255,686 | 6/1966 | Larson et al. | 98/39.1 |
| 3,883,264 | 5/1975 | Rao | 244/199 |
| 4,418,880 | 12/1983 | Waal | 415/3.1 |
| 4,692,091 | 9/1987 | Ritenour | 415/119 |
| 4,786,231 | 11/1988 | Kelley | 415/119 |
| 4,799,287 | 1/1989 | Belanger et al. | 415/206 |

FOREIGN PATENT DOCUMENTS

| | | | |
|---|---|---|---|
| 0048800 | 3/1983 | Japan | 415/119 |

*Primary Examiner*—Edward K. Look
*Assistant Examiner*—Hoang Nguyen
*Attorney, Agent, or Firm*—Klarquist, Sparkman, Campbell, Leigh & Whinston

[57] ABSTRACT

A grate of rigid intersecting strips is positioned across the inlet cone of a fan for diffusing the vortex of inlet air to the fan and to induce a uniform velocity gradient at the fan blades. This conditioning of the inlet air reduces turbulence during operation of the fan and, therefore, noise and vibration.

6 Claims, 2 Drawing Sheets

INLET AIR FLOW CONDITIONING FOR CENTRIFUGAL FANS

TECHNICAL FIELD

This invention pertains to mechanisms for conditioning inlet air flow to centrifugal fans.

BACKGROUND INFORMATION

Centrifugal fans for commercial applications typically include a fan wheel that is rotated by a motor. The fan wheel includes a generally flat, circular back plate and a plurality of spaced-apart blades arranged near the circumferential edge of the back plate. The blades protrude outwardly from the plane of the back plate. As the back plate is rotated by the motor, the blades rotate about the rotational axis of the fan wheel, which axis is perpendicular to the center of the back plate.

The blades are sized so that there is a central cavity within the fan wheel, the cavity being defined between the radially innermost ends of the blades. The blades are angled so that, as the fan operates, inlet air is drawn into the cavity in a direction generally parallel to the fan wheel rotational axis and forced radially outwardly from the cavity. The fan wheel is contained in a housing that directs the outlet air into the distribution system to which the fan is connected.

A generally frustum-shaped inlet cone is mounted near the cavity of the fan wheel. The cone is shaped to direct ambient air into the fan wheel cavity.

The path of the air that flows to the rotating fan wheel forms a vortex. The vortex exhibits a nonuniform velocity gradient as measured normal to the air flow. The vortex and non-uniform inlet air velocity combine to generate turbulence that produces unwanted noise and vibration during operation of the fan.

SUMMARY OF THE INVENTION

This invention is directed to an apparatus for conditioning the inlet air flow to a centrifugal fan so that the air mass reaching the fan wheel blades is substantially uniform, thereby significantly reducing the noise and vibration normally associated with inlet air flow paths that reach the fan blades.

This invention particularly comprises a rigid grate that is mounted to the fan to extend across the inlet cone of the fan. The grate comprises thin, flat strips of intersecting rigid material. The interstices of the grate define a multitude of discrete parallel air-flow passages that combine to convert the inlet air flow path from a vortex of unevenly distributed air mass to a substantially uniform-mass flow to the fan wheel blades.

DETAILED DESCRIPTION OF PREFERRED EMBODIMENTS

Figure 1:
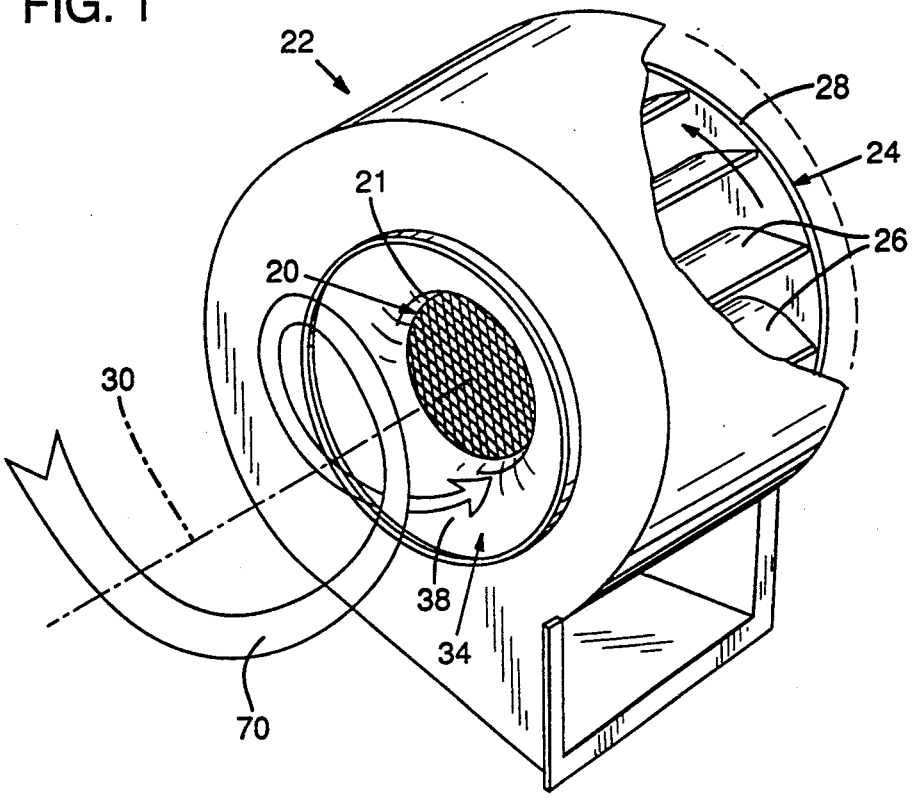
FIG. 1 is a perspective view of a centrifugal fan that incorporates the flow conditioning apparatus of the present invention.
Figure 2:
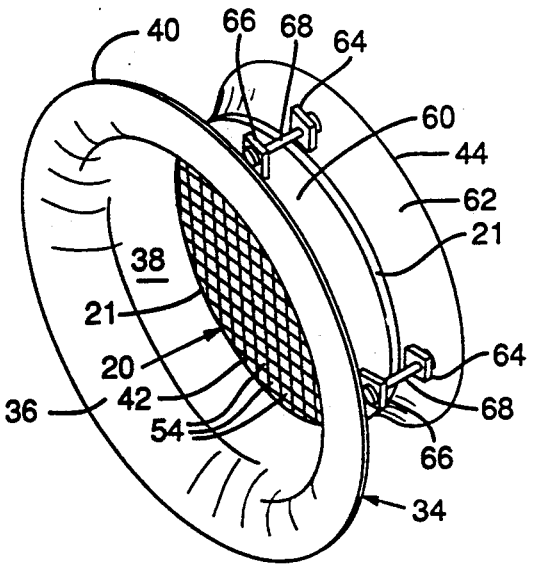
FIG. 2 is a front perspective detail view of an inlet cone of a centrifugal fan that has attached to it a flow conditioning apparatus of the present invention.
Figure 3:
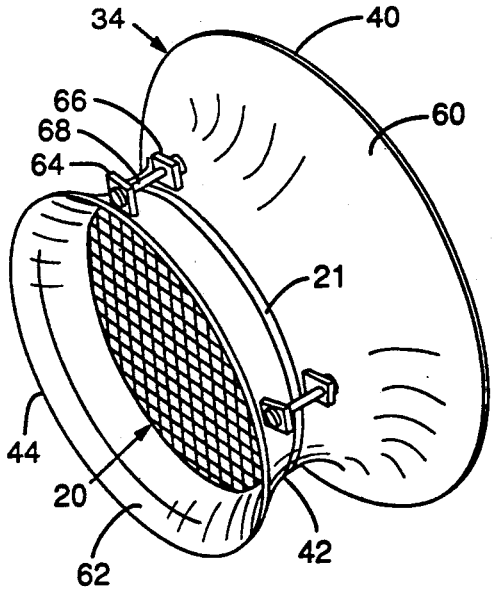
FIG. 3 is a back perspective view of the inlet cone and attached flow conditioning apparatus.

As shown in FIGS. 1-3, the inlet air flow conditioning apparatus 20 of the present invention is employed with a conventional fan 22. The fan 22 includes a fan wheel 24 that has a plurality of blades 26 mounted near the periphery of the back wall 28 of the fan wheel 24. The wheel 24 is driven by a motor (not shown) that rotates the wheel 24 about an axis 30 that is substantially perpendicular to, and concentric with, the circular back wall 28 of the fan. Inlet air is drawn toward the fan wheel 24 and forced radially outwardly by the blades 26.

A hollow inlet cone 34 is mounted adjacent to the fan wheel 24. The cone 34 has a central axis that is collinear with the rotational axis 30 of the fan. The inlet cone 34 is generally frustum-shaped, having a curved wall 36 that defines a generally convex interior surface 38. From the inlet edge 40 of the cone 34, the inside diameter of the cone gradually decreases to a minimum diameter region or throat 42 that is located between the inlet edge 40 and the outlet edge 44 of the cone. The inside diameter of the cone gradually increases in the direction from the throat 42 toward the outlet edge 44.

Figure 6:
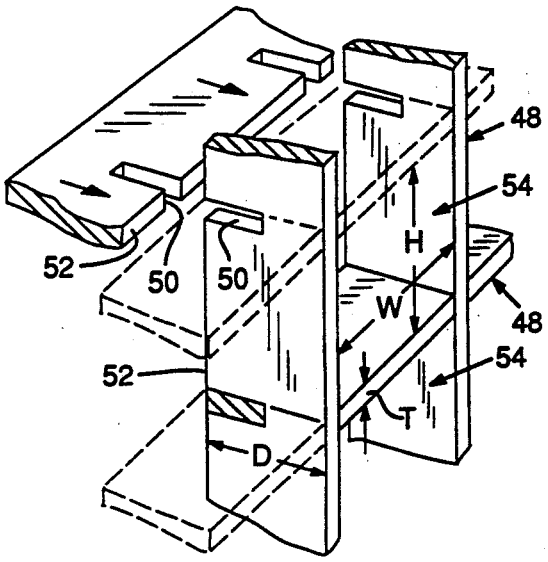
FIG. 6 is an enlarged detail view of the - apparatus of the present invention.

The apparatus 20 of the present invention comprises a grate 21 of thin, rigid strips of intersecting material, such as aluminum. Referring to the detail view of FIG. 6, the individual strips 48 are formed with spaced apart notches 50 that extend from one edge 52 of the strip to the mid-point of the depth D of the strip 48. The width of the notches 50 are approximately equal to the thickness T of the strips 48. The grate 21 is assembled by arranging one group of parallel strips 48 in perpendicular relationship with another group of parallel strips 48 so that the notches 50 of one group face the notches 50 of the other group. The strips are then press fit together so that the notches 50 in one group of strips 48 receive the portion of the opposing strip that is immediately adjacent to the notch (FIG. 6).

It is contemplated that any of a number of techniques may be used to form the grate 21 of intersecting ridged strips. For example, the grate may be cast as a unitary article. Moreover, the material used for making the strips can be any suitable rigid metal or plastic.

The intersecting strips 48 define across the grate 21 a multitude of discrete passages 54. Preferably, the passages 54 are square in cross-section (i.e., dimensions H and W being equal in FIG. 6), although the strips 48 may be arranged to define other passage cross-sectional shapes such rectangular or hexagonal. The area of the passages should be between about 1.6 $cm^2$ and 6.4 $cm^2$.

The length of the passages 54 (i.e., dimension D in FIG. 6) is preferably between 1.3 cm and 2.5 cm. It has been found that this range of passage lengths is effective for diffusing the vortex 70 (FIG. 1) of inlet air flow into the cone 34, and for producing a grate of sufficient rigidity to withstand, without deforming, the force of the air entering the fan 22.

Preferably, the strips 48 have a thickness T that is as small as possible, yet still providing sufficient rigidity to the grate 21. Strips 48 made of aluminum have been used to construct an effective grate 21 having strip thickness T as thin as about 0.4 millimeters (mm).

In the preferred embodiment, the rigid grate 21 is mounted to the inlet cone 34 to extend across the minimum diameter portion or throat 42 of the cone 34. One technique for mounting the grate 21 to the cone 34 is depicted in FIGS. 2 and 3. As shown in those FIGURES, the grate 21 is sandwiched between an outer component 60 and an inner component 62 of the cone 34. In this regard, a conventional cone 34 may be cut along a plane that is perpendicular to the central axis of the cone at the throat 42 of the cone, thereby forming the two components 60, 62 just mentioned. Alternatively, a cone may be initially manufactured as two components 60, 62.

Radially protruding brackets 64 are attached to the inner component 62 of the cone 34. Those brackets 64 align with correspondingly shaped brackets 66 that radially protrude from the outer component 60 of the cone. Threaded fasteners 68 are used for connecting the brackets 64 and 66 so that the inner and outer components 60, 62 of the inlet cone 34 can be tightened against the grate 21 to securely fasten the grate in place.

Referring to FIG. 1, normal operation of the fan generates a vortex 70 of air flowing into the inlet cone 34. As mentioned above, this vortex 70 includes unevenly distributed air mass that reaches the blades 26, thereby causing turbulence and vibration. With the grate 21 in place as just described, the vortex 70 of inlet air impinges upon the grate 21 and is diffused and redirected by the grate passages 54 so that the mass of the air flowing out of the grate 21 is more uniformly distributed as it encounters the fan blades 26. As a result, turbulence at the fan blades is minimized, as is the noise and vibration that would accompany such turbulence.

Figure 4:
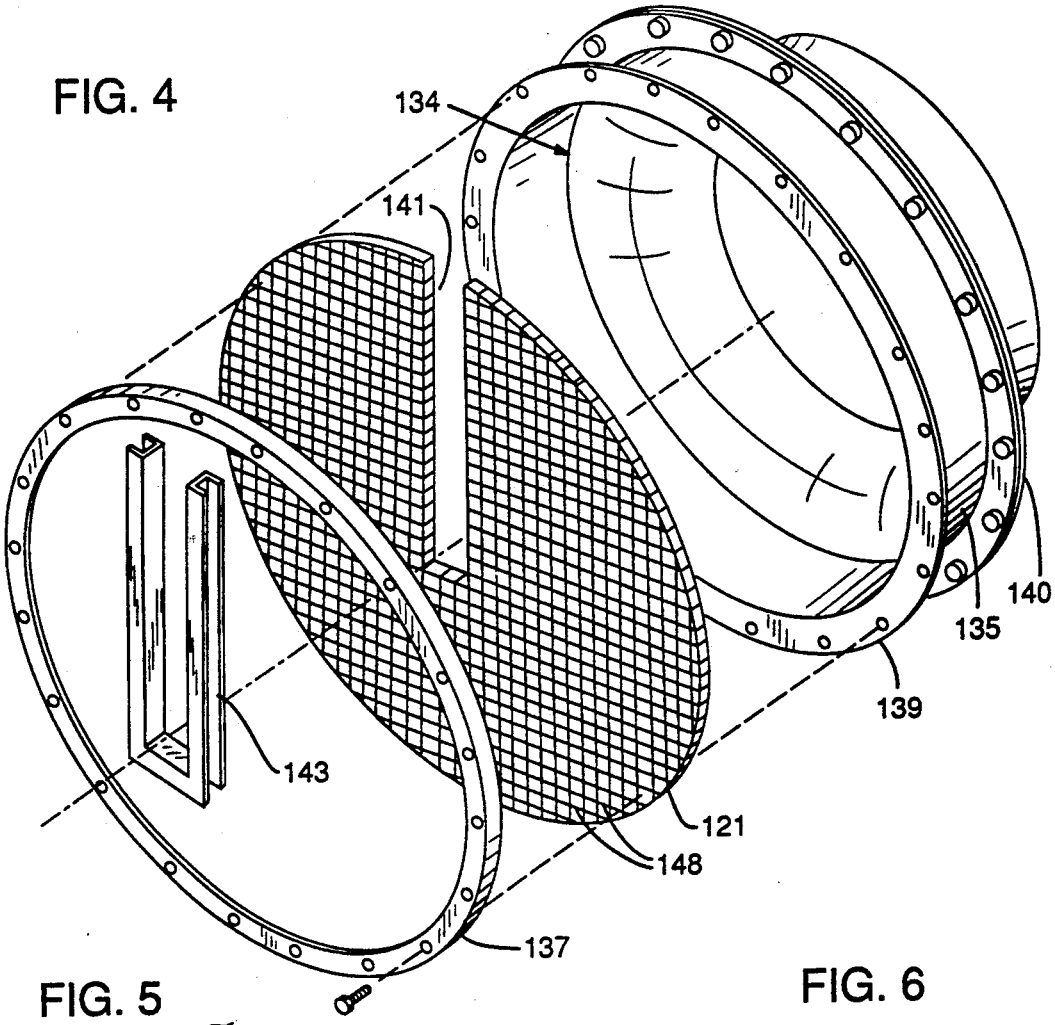
FIG. 4 is an exploded perspective view of an alternative embodiment of a flow conditioning apparatus of the present invention.
Figure 5:
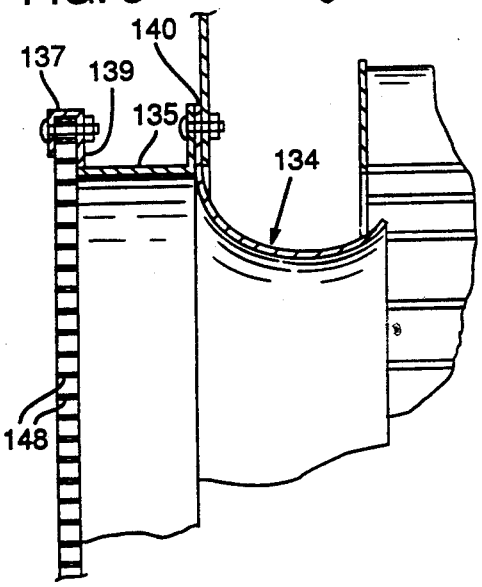
FIG. 5 is an enlarged cross-sectional detail view of the assembly depicted in FIG. 4.

It is contemplated that the grate 21 may be located relative to the inlet cone at a position away from the throat as described above. For instance, FIGS. 4 and 5 depict an alternative arrangement for attaching the grate 121 to a single-piece inlet cone 134. To this end, the grate, which is fabricated in the manner described with respect to FIG. 6, is fastened to an annular frame 135 that is carried on the inlet edge 140 of the inlet cone 134. An annular bracket 137 is fastened to the frame 135, thereby securing the grate 121 between the bracket 137 and a radially protruding flange 139 that extends from the frame 135.

In some applications, it may be necessary to provide an opening through the grate 121 to provide clearance for mechanisms that extend into the inlet cone 134 of the fan. As shown in FIG. 4, such an opening 141 may be formed by removing portions of individual grate strips 148 to create the required opening size. Preferably, the portion of the grate 121 that borders the opening 141 is reinforced with a rigid channel member 143 that is shaped to conform to the opening 141.

While the invention has been illustrated and described in the context of preferred embodiments, it will be apparent to those skilled in the art that changes and modifications may be made without departing from the invention. Accordingly, the appended claims are intended to cover all such changes and modifications as fall within the true spirit and scope of the invention.

I claim:

1. An apparatus for diffusing the flow of air to the inlet cone of a fan, comprising a substantially flat grate of intersecting strips of rigid material, the strips defining a multitude of discrete air flow passages through the grate, and a reinforcing part attached to the grate and defining an opening through the grate, the opening being substantially larger than the discrete passages.

2. The apparatus of claim 1 wherein the strips are arranged to define flow passages having substantially square cross sectional areas of between about 1.6 $cm^2$ and 6.4 $cm^2$.

3. The apparatus of claim 1 wherein the strips range in thickness from between about 0.4 to 1.0 mm.

4. The apparatus of claim 1 wherein the strips are sized so that the length of the flow passages defined by the strips is between about 1.3 cm and 2.5 cm.

5. An apparatus for conditioning inlet air flowing to a fan, comprising:

a rotatable fan wheel having blades attached thereto;

an inlet member having an inlet edge and an outlet edge and shaped for defining between those edges a passageway through which inlet air flows, the inlet member being mounted adjacent to the fan wheel with the fan wheel adjacent the outlet edge of the inlet member, the inlet member having a throat portion between the inlet edge and outlet edge, the inlet member being configured so that the diameter of the passageway gradually decreases in the direction from the inlet edge to the throat portion and so that the diameter of the passageway gradually increases in the direction from the throat portion to the outlet edge; and a grate of intersecting strips of rigid material mounted to the throat portion of the inlet member to extend across the passageway.

6. The apparatus of claim 5 wherein the strips of the inlet member grate are arranged to define flow passages having substantially square cross sectional areas of between about 1.6 $cm^2$ and 6.4 $cm^2$.

* * * * *